United States Patent [19]

Moller

[11] Patent Number: 4,559,631

[45] Date of Patent: Dec. 17, 1985

[54] HEAT TREATING FURNACE WITH GRAPHITE HEATING ELEMENTS

[75] Inventor: Craig A. Moller, Loves Park, Ill.

[73] Assignee: Abar Ipsen Industries, Feasterville, Pa.

[21] Appl. No.: 651,225

[22] Filed: Sep. 14, 1984

[51] Int. Cl.[4] ..... H05B 3/06

[52] U.S. Cl. ..... 373/130; 373/134; 338/295; 338/289

[58] Field of Search ..... 373/109, 110, 111, 130, 373/134, 137; 219/390, 408, 539, 541, 552, 553, 542; 338/283–285, 288, 289, 294, 295, 315, 320

[56] References Cited

U.S. PATENT DOCUMENTS

| | | | |
|---|---|---|---|
| 4,117,252 | 9/1978 | McMaster | 13/25 |
| 4,126,757 | 11/1978 | Smith, Jr. et al. | 13/25 |
| 4,246,434 | 1/1981 | Gunther et al. | 219/390 |
| 4,247,734 | 1/1981 | Gunther et al. | 373/109 |
| 4,249,032 | 2/1981 | Smith, Jr. et al. | 13/25 |
| 4,347,431 | 8/1982 | Pearce et al. | 219/390 |
| 4,435,819 | 3/1984 | Plume | 373/119 |

OTHER PUBLICATIONS

Ipsen Industries Drawing No. C–126677 dated 5/5/78; No. D–14832 dated 9/18/82; and No. D–148178 dated 9/22/82.

*Primary Examiner*—Roy N. Envall, Jr.
*Attorney, Agent, or Firm*—Leydig, Voit & Mayer, Ltd.

[57] ABSTRACT

A heat treating furnace having a work chamber of circular cross-section and having banks of electric resistance heating elements formed by rigid and elongated graphite bars. The graphite bars of each bank are interconnected so as to form an octagon located closely adjacent the circular wall of the work chamber and closely approximating the circular shape of the chamber. As a result of the octagonal arrangement, ring-like banks of rigid graphite elements may be space longitudinally along the circular work chamber to enable front-to-rear temperature trim zones to be established in the chamber.

6 Claims, 5 Drawing Figures

HEAT TREATING FURNACE WITH GRAPHITE HEATING ELEMENTS

BACKGROUND OF THE INVENTION

This invention relates to a heat treating furnace of the type in which electric resistance heating elements are disposed inside of a work chamber to radiantly heat workpieces therein. More specifically, the invention relates to a furnace of the type in which the work chamber is of circular cross-section and in which the heating elements are made of rigid graphite bars.

In most prior furnaces of this type, the graphite heating bars are arranged in a circle around the chamber and extend longitudinally of the furnace between the front and rear thereof. As a result, it is not feasible to easily arrange the elements in groups or banks which may be differentially located and/or energized in order to establish front-to-rear temperature trim zones in the furnace.

SUMMARY OF THE INVENTION

The general aim of the present invention is to provide an electric heat treating furnace having a chamber of circular cross-section and having rigid graphite heating bars uniquely arranged in longitudinally spaced, ring-like banks conforming substantially to the circular shape of the chamber and enabling front-to-rear temperature trim zones to be created in the chamber.

A more detailed object is to achieve the foregoing by connecting the rigid graphite bars end-to-end to form a heating element bank in the shape of an octagon or the like, the bars extending chordwise of the circular chamber in close proximity to the wall thereof and obstructing relatively little space in the chamber. Several of the banks are spaced longitudinally within the chamber and may be either differentially spaced or differentially energized to enable front-to-rear temperature trim zones to be established.

The invention also resides in the provision of unique brackets which suspend the graphite bars from the wall of the chamber and which also enable adjacent bars to be connected to one another to form an octagon or the like.

These and other objects and advantages of the invention will become more apparent from the following detailed description when taken in conjunction with the accompanying drawings.

DETAILED DESCRIPTION OF THE PREFERRED EMBODIMENT

Figure 1:
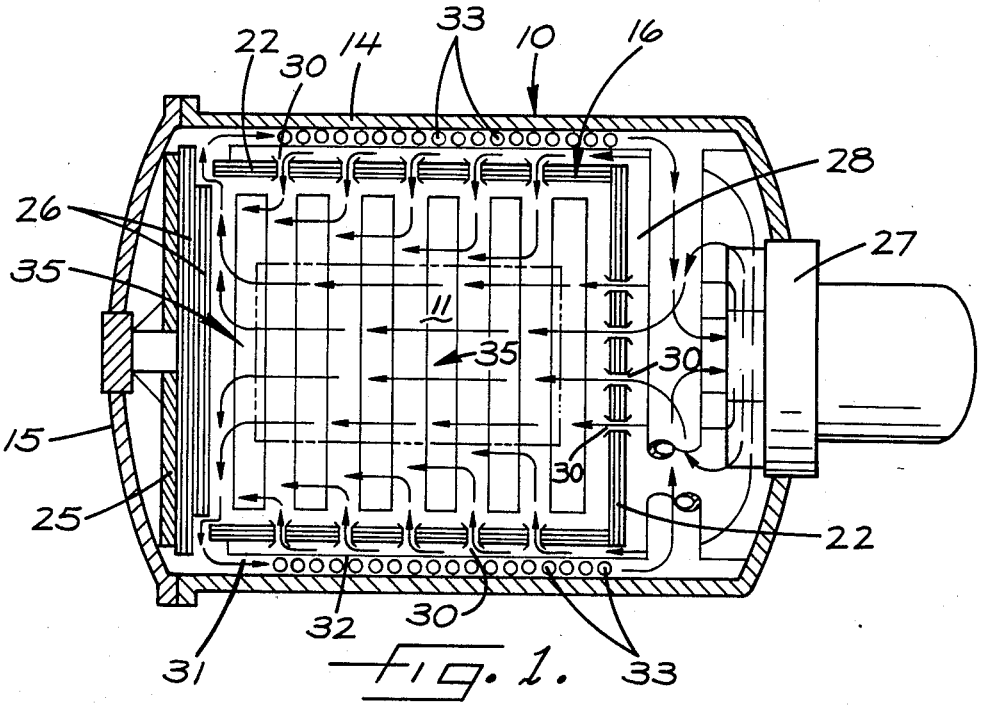
FIG. 1 is a schematic cross-sectional view taken longitudinally through a heat treating furnace equipped with new and improved graphite heating element banks incorporating the unique features of the present invention.
Figure 3:
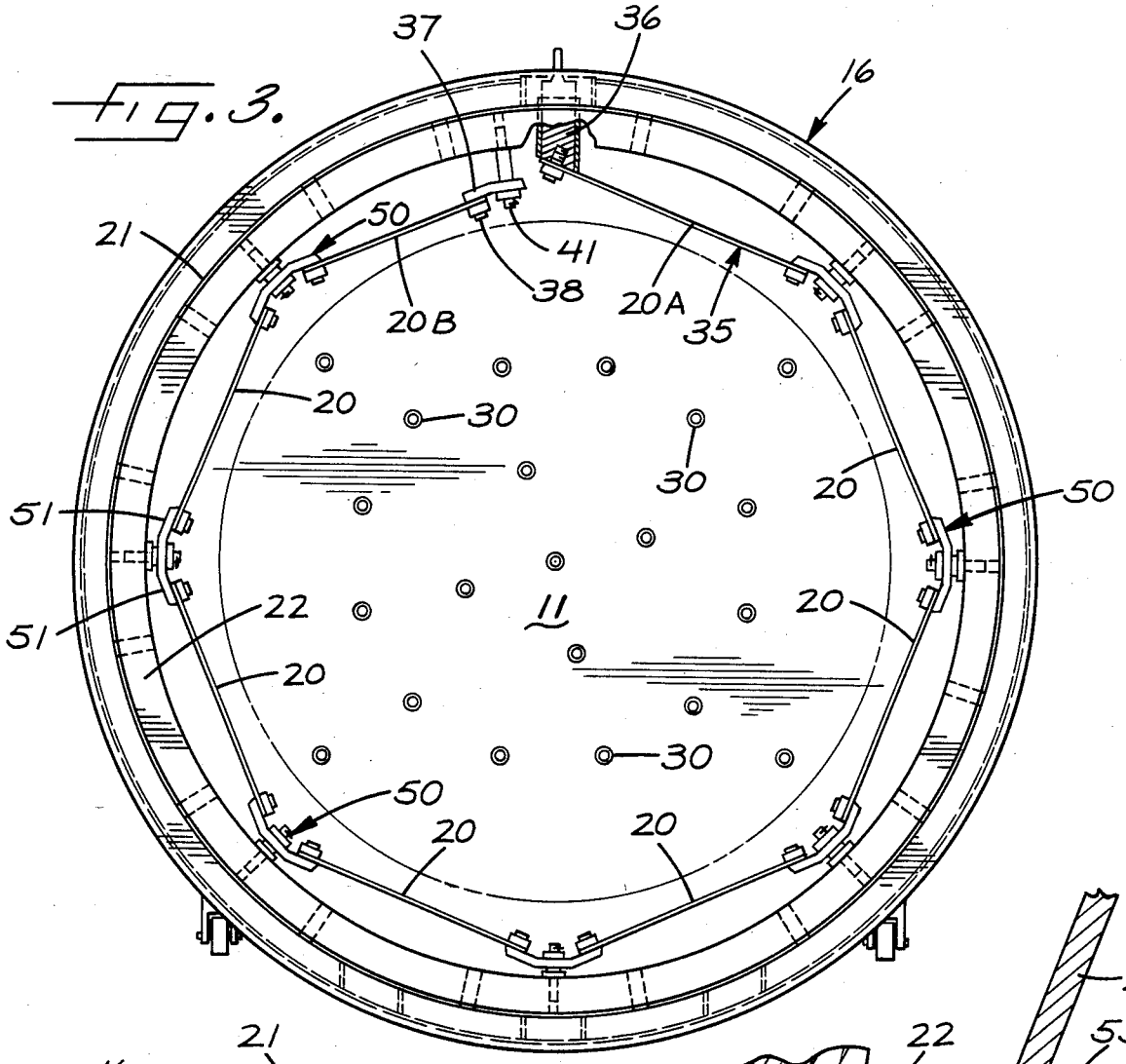
FIG. 3 is an enlarged cross-sectional view taken substantially along the line 3—3 of FIG. 2.

For purposes of illustration, the invention is shown in the drawings in conjunction with a vacuum furnace 10 for heat treating workpieces (not shown) in a chamber 11 (FIG. 3). In general, the furnace comprises a substantially cylindrical outer vessel or shell 14 (FIG. 1) having a circular internal cross-section and closed at its forward end by a releasable door 15. The heating chamber 11 is defined within an internal structure in the form of a walled enclosure 16 disposed inside of the shell and spaced inwardly from the walls thereof. Several groups of electric resistance heating elements 20 (FIG. 3) are located within the internal enclosure 16 to heat the workpieces.

Figure 2:
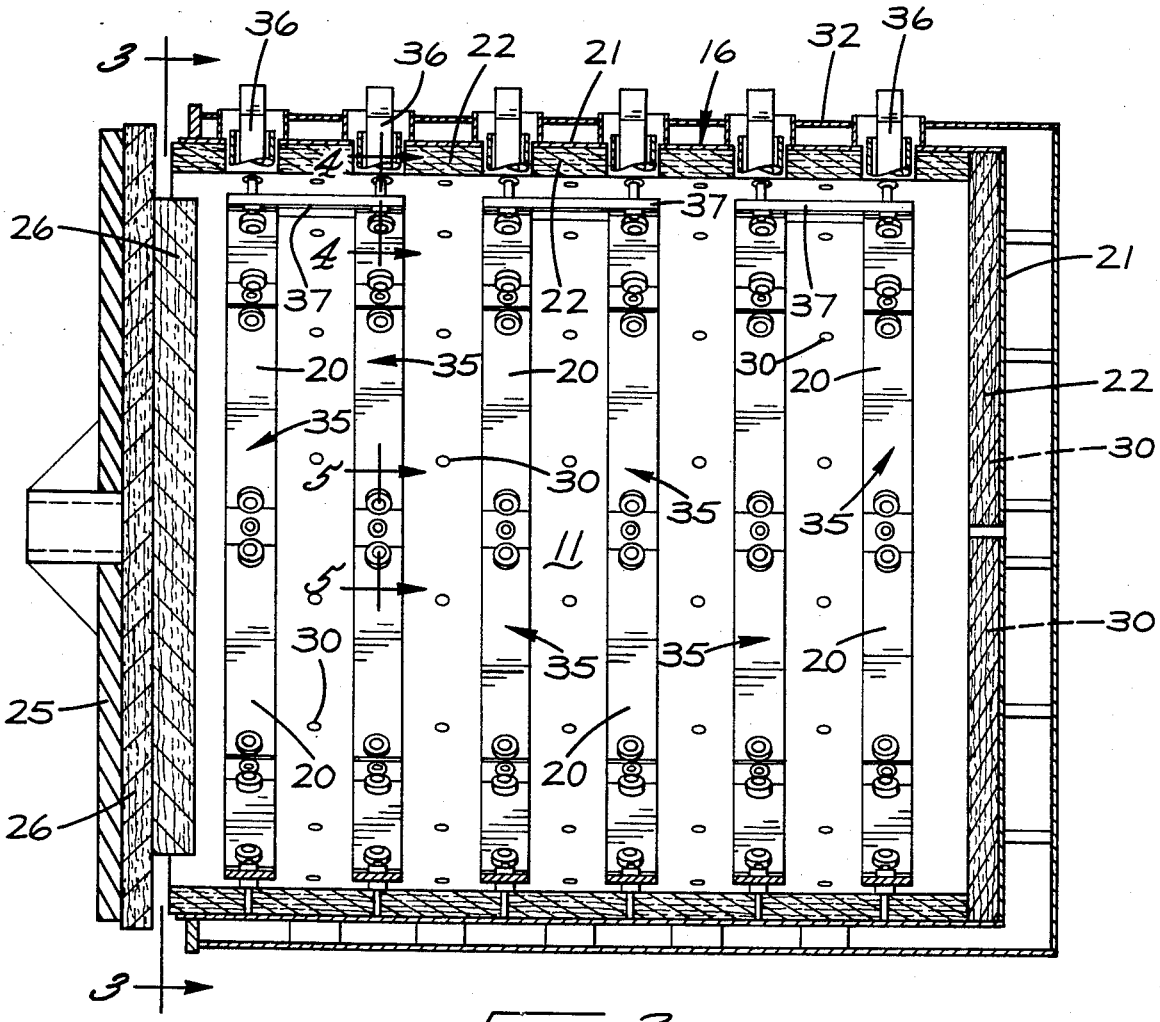
FIG. 2 is an enlarged cross-sectional view taken longitudinally through the internal structure of the furnace shown in FIG. 1.
Figure 4:
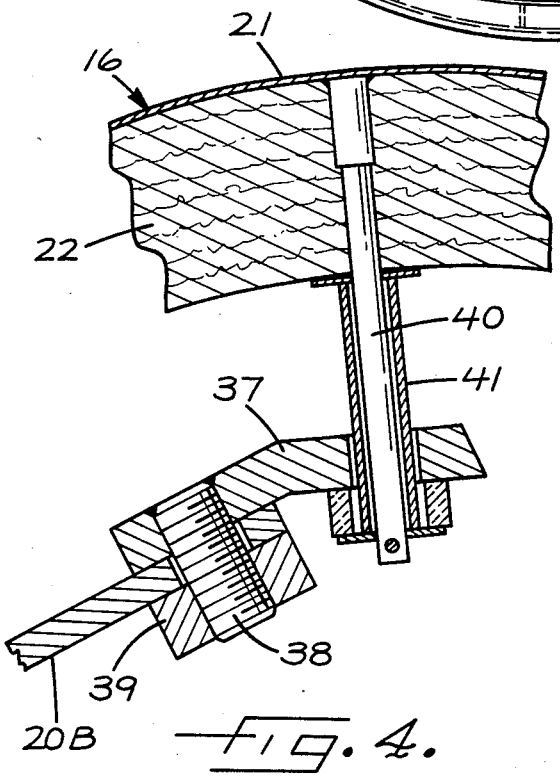
FIGS. 4 and 5 are enlarged fragmentary cross-sections taken substantially along the lines 4—4 and 5—5, respectively, of FIG. 2.

The internal enclosure 16 also is of circular cross-section and includes a flat rear wall and a circular side wall. Each wall is defined by a metal outer wall member or skin 21 (FIGS. 2 and 4) and by suitable insulation packs 22.

As shown most clearly in FIG. 3, the wall of the work chamber 11 is defined by the innermost side of the insulation packs 22, the chamber being of circular cross-section and being closed at its rear end by a vertical insulation pack. The front of the chamber is adapted to be closed off by a door-like structure 25 (FIGS. 1 and 2) carried by the main door 15 of the shell 14 and having insulation packs 26 for blocking and insulating the front of the chamber.

After the workpieces have been heated, a motor-driven blower 27 (FIG. 1) at one end of the shell 14 circulates an inert cooling gas such as argon or nitrogen through the chamber 11 in order to quench the workpieces. As shown schematically in FIG. 1, the gas is directed into the space 28 between the shell 14 and the enclosure 16 and flows into the chamber through tubular nozzles 30 located in the wall of the enclosure 16. The gas discharged out of the chamber 11 flows past the insulation packs 26 on the door structure 25 and returns to the blower 27 via a plenum 31 defined between the shell 14 and a jacket 32 which encircles the enclosure 16. Banks of cooling coils 33 are located in the plenum and chill the gas during its return flow.

The heating elements 20 are made from rigid and elongated bars of graphite, the bars 20 herein being straight and having a rectangular cross-section. Graphite bars previously have been used as the heating elements for heat treating furnaces and the advantages of graphite bars themselves are well known.

In accordance with the present invention, the graphite heating bars 20 are connected end-to-end with one another to form ring-like banks 35 spaced longitudinally within the circular work chamber 11 and adapted to be differentially located and/or energized in order to enable front-to-rear temperature trim zones to be established within the chamber. As shown in FIG. 3, the graphite bars are arranged so as to define a substantially regular polygon, preferably an octagon, within the chamber so that the bars may be located in close proximity to the circular wall 22 of the chamber. In this way, the elongated and rigid graphite bars may be formed into a ring-like heating element bank in the circular chamber to enable temperature trim control and yet, being closely adjacent the wall of the chamber, the bars obstruct relatively little work space in the chamber.

More specifically, the present furnace 10 has been shown as including six longitudinally spaced banks 35 of graphite heating elements or bars 20, each bank herein being formed by eight separate bars although as few as six bars could be used with a sacrifice of usable work space. Adjacent ends of adjacent bars in a bank are electrically and mechanically connected in a manner to be explained except that the left end of the bar 20A (FIG. 3) immediately to the right of the twelve o'clock position is not mechanically connected to the right end of the bar 20B immediately to the left of the twelve o'clock position. Instead, the left end of the bar 20A is connected to a power feed through conductor 36 (shown schematically in the drawings) which extends through the internal enclosure and which connects the bank of heating elements to a voltage source. A graphite cross connector 37 (FIGS. 2, 3 and 4) is attached to the right end of the bar 20B by a graphite screw 38 and a graphite nut 39 and connects the bar 20B electrically with the corresponding bar 20B of a longitudinally paired bank 35 having a bar 20A connected to another power feed through conductor 36. The cross connector is supported on a hanger rod 40 (FIG. 4) attached to and extending inwardly from the wall 21 of the internal enclosure 16. An insulating sleeve 41 and an insulating washer 42 prevent the connector 37 from shorting through the hanger rod 40.

The bars 20 all are of equal length except that the bar 20B is just somewhat shorter than the other seven bars. Also, adjacent bars are inclined relative to one another at an included angle of roughly 135 degrees. Accordingly, the bars define a substantially regular octagon around the outer portion of the chamber. Because of the octagonal shape, the bars lie along relatively short chords which closely approximate a circle and thus the shape of the overall heating element bank conforms closely to the circular shape of the chamber 11. As a result, the bars 20 do not occupy any significant area in the center portion of the chamber and do not significantly reduce the work-holding capacity of the chamber. Moreover, the octagonal arrangement of the bars causes heat from the bars to be radiated toward the center of the chamber in a substantially uniform manner approximating that effected by truly circular metal heating elements.

Because the heating elements 20 are arranged in longitudinally spaced banks 35, various banks may be differentially energized in order to establish front-to-rear temperature trim zones. For example, more power may be applied to the front two banks to compensate for heat loss through the doors 15 and 25 and to enable a substantially uniform temperature to be maintained along the length of the furnace in spite of such heat loss. Alternatively, equal power may be applied to all of the banks and a greater number of banks may be concentrated adjacent the forward end portion of the chamber 11 to compensate for heat loss through the doors.

Figure 5:
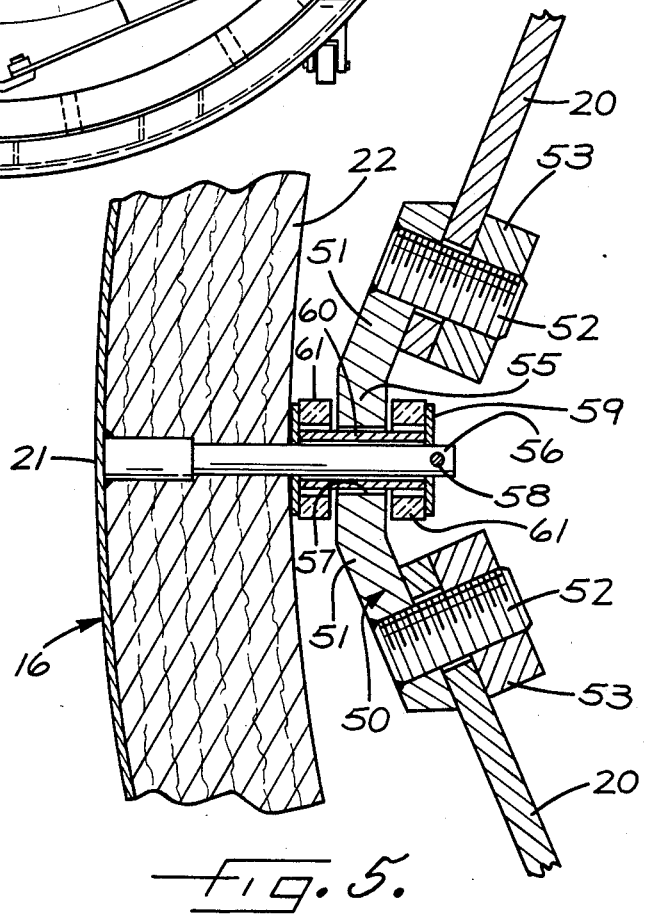

The present invention also contemplates the provision of novel mounting brackets 50 (FIGS. 3 and 5) for electrically and mechanically interconnecting the bars 20 and for suspending the bars from the internal enclosure 16. Herein, each bracket is made of a single piece of graphite and includes two oppositely extending wings 51 inclined relative to one another at the same obtuse included angle as the bars. Adjacent ends of adjacent bars are conductively connected to the wings by graphite screws 52 and graphite nuts 53.

Each bracket 50 also includes a plate-like mounting section 55 (FIG. 5) formed integrally with and extending between the two wings 51. The mounting section of each bracket is disposed substantially perpendicular to a radius of the chamber 11. Extending inwardly along such radius is a hanger rod 56 whose outer end is attached to the outer wall 21 of the enclosure 16. The inner end portion of the hanger rod extends through a hole 57 in the mounting section 55 and thus suspends the bracket 50 and the bars 20 from the wall 21. The bracket 50 is captivated on the rod 56 by a pin 58 and a washer 59 and is electrically insulated by a ceramic sleeve 60 and ceramic washers 61.

The brackets 50 are of relatively simple construction and yet they serve the dual purpose of connecting the bars 20 to one another in an octagonal bank and of suspending the bars within the chamber 11.

I claim:

1. An electric heat treating furnace comprising an enclosure having an inner wall of circular cross-section and defining a heating chamber of circular cross-section, a plurality of banks of electric resistence heating elements spaced longitudinally within said chamber, each of said banks comprising a series of at least six rigid and substantially straight elongated bars made of graphite, the graphite bar of each bank being formed separately of every other bar of the bank means connected to one of the bars of each bank for conducting electrical power thereto, means formed separately of said bars for electrically and mechanically interconnecting the bars of each bank, the bars of each bank being approximately equal in length and extending chordwise of said chamber with obtuse and substantially equal included angles between each pair of adjacent bars so that the bars define a substantially regular polygon within the circular chamber.

2. A furnace as defined in claim 1 in which each bank includes a series of eight bars which are interconnected so as to define a substantially regular octagon within said chamber.

3. A furnace as defined in claim 1 in which said interconnecting means comprise electrically conductive brackets, each of said brackets having a first wing connected to one end of one of the bars and having a second wing connected to the adjacent end of an adjacent bar, there being an obtuse included angle between the two wings.

4. A furnace as defined in claim 3 in which each bracket further includes a mounting section extending between and joined to the two wings and disposed substantially perpendicular to a radius of said chamber, and means extending radially from said wall and through said mounting section for attaching said bracket to said wall.

5. A furnace as defined in claim 4 in which each bracket is formed from a single piece of graphite.

6. An electric heat treating furnace comprising an enclosure having an inner wall of circular cross-section and defining a heating chamber of circular cross-section, a plurality of banks of electric resistance heating elements spaced longitudinally within said chamber, each of said banks comprising a series of eight rigid and substantially straight elongated bars made of graphite, the graphite bar of each bank being formed separately of every other bar of the bank, means connected to one of the bars of each bank for conducting electrical power thereto, the bars of each bank being approximately equal in length and extending chordwise of said chamber with obtuse and substantially equal included angles between each pair of adjacent bars so that the bars define a substantially regular octagon within the circular chamber, means for electrically and mechanically interconnecting the bars of each bank, said interconnecting means comprising brackets each made of a single piece of graphite, each of said brackets having a first wing connected to one end of one of the bars and having a second wing connected to the adjacent end of an adjacent bar, there being an obtuse included angle between the two wings, each of said brackets further including a mounting section extending between and joined to the two wings and disposed substantially perpendicular to a radius of said chamber, and means extending radially from said wall and through the mounting section of each bracket for attaching the bracket to said wall.

* * * * *